US006840759B2

(12) United States Patent
Aronson, II et al.

(10) Patent No.: US 6,840,759 B2
(45) Date of Patent: Jan. 11, 2005

(54) IGNITER INCORPORATING A SAFETY LOCKING DEVICE

(75) Inventors: Louis V. Aronson, II, Oldwick, NJ (US); Adam Grabicki, Hopatcong, NJ (US); Lee J. Hadfield, Lebanon, NJ (US)

(73) Assignee: Ronson Corporation, Woodbridge, NJ (US)

( * ) Notice: Subject to any disclaimer, the term of this patent is extended or adjusted under 35 U.S.C. 154(b) by 0 days.

(21) Appl. No.: 10/039,203

(22) Filed: Jan. 4, 2002

(65) Prior Publication Data

US 2003/0129554 A1 Jul. 10, 2003

(51) Int. Cl.[7] ..... F23D 11/36; F23Q 2/28
(52) U.S. Cl. ..... 431/153; 431/255
(58) Field of Search ..... 431/153, 255, 431/344, 345

(56) References Cited

U.S. PATENT DOCUMENTS

| | | | | |
|---|---|---|---|---|
| 3,606,610 | A | | 9/1971 | Leach |
| 3,898,031 | A | | 8/1975 | Rusakowicz |
| 4,538,983 | A | | 9/1985 | Zeller et al. |
| 4,784,601 | A | | 11/1988 | Nitta |
| 4,832,596 | A | | 5/1989 | Morris, Sr. |
| 5,002,482 | A | | 3/1991 | Fairbanks et al. |
| 5,076,783 | A | | 12/1991 | Fremund |
| 5,120,215 | A | | 6/1992 | Amoros Nollas |
| 5,145,358 | A | | 9/1992 | Shike et al. |
| 5,184,948 | A | | 2/1993 | Iwahori |
| 5,199,865 | A | | 4/1993 | Liang |
| 5,240,408 | A | | 8/1993 | Uematsu et al. |
| 5,242,297 | A | | 9/1993 | Cirami |
| 5,326,256 | A | | 7/1994 | Shike et al. |
| 5,348,467 | A | | 9/1994 | Piffath et al. |
| 5,368,473 | A | | 11/1994 | Kenjiro et al. |
| 5,421,720 | A | | 6/1995 | Sher |
| 5,451,159 | A | | 9/1995 | Kim |
| 5,458,482 | A | | 10/1995 | Saito et al. |
| 5,462,432 | A | | 10/1995 | Kim |
| 5,492,468 | A | | 2/1996 | Cirami |
| 5,496,169 | A | | 3/1996 | Chen |
| 5,531,591 | A | * | 7/1996 | Yamazaki ..... 431/153 |
| 5,558,514 | A | | 9/1996 | Ansquer |
| 5,584,682 | A | | 12/1996 | McDonough et al. |
| 5,655,901 | A | | 8/1997 | Makoto |
| 5,697,775 | A | | 12/1997 | Saito et al. |
| 5,788,474 | A | | 8/1998 | Chung et al. |
| 5,788,476 | A | | 8/1998 | Sher |
| 5,897,308 | A | | 4/1999 | Saito et al. |
| 5,967,768 | A | | 10/1999 | Saito et al. |
| 5,980,242 | A | | 11/1999 | Man |
| 6,010,328 | A | | 1/2000 | Sung |
| 6,022,212 | A | | 2/2000 | Saito et al. |
| 6,042,367 | A | | 3/2000 | Saito et al. |
| 6,050,810 | A | | 4/2000 | Huang |
| 6,059,563 | A | | 5/2000 | Hsu |
| 6,077,069 | A | | 6/2000 | Fairbanks et al. |
| 6,086,359 | A | | 7/2000 | Sher |
| 6,093,017 | A | | 7/2000 | Saito et al. |
| 6,200,130 | B1 | * | 3/2001 | Man ..... 431/153 |
| 6,264,463 | B1 | * | 7/2001 | Sung ..... 431/153 |
| 6,287,109 | B1 | * | 9/2001 | Hirota ..... 431/153 |

FOREIGN PATENT DOCUMENTS

| | | | | |
|---|---|---|---|---|
| DE | 39 27 704 C2 | | 12/1990 | |
| EP | 0 345 729 A2 | | 12/1989 | |
| EP | 0 488 158 A2 | | 6/1992 | |
| EP | 0 551 654 A2 | | 7/1993 | |
| JP | 62-5565 | | 12/1983 | |
| JP | 60-122828 | | 7/1985 | |
| JP | 5-256448 | | 10/1993 | |
| JP | 6-18030 | | 1/1994 | |
| JP | 406307638 A | | 11/1994 | |
| JP | 2003-14230 A | * | 1/2003 | ..... F23Q/2/28 |
| WO | WO 90/02908 | | 3/1990 | |
| WO | WO 91/10098 | | 7/1991 | |
| WO | WO 92/08931 | | 5/1992 | |
| WO | WO 97/46832 | | 12/1997 | |
| WO | WO 99/60309 | | 11/1999 | |

* cited by examiner

*Primary Examiner*—Josiah Cocks
(74) *Attorney, Agent, or Firm*—Lerner, David, Littenberg, Krumholz & Mentlik, LLP

(57) ABSTRACT

An igniter includes a child resistant safety locking trigger. The trigger is provided with a release slider which is movable along the trigger body along a path arranged at an angle to the path of travel of the trigger body when being depressed for activation of the igniter. A stop member within the igniter prevents operation of the trigger until the release slider is moved to a release position.

64 Claims, 10 Drawing Sheets

RELEASE CHILD SAFETY BY LIFTING THE SPRING LOADED SLIDER UP USING INDEX FINGER

WHILE HOLDING CHILD SAFETY RELEASE SLIDER UP, SQUEEZE TRIGGER TO LIGHT IGNITOR

IGNITOR AT REST WITH CHILD SAFETY RESET AND IGNITOR SHUT OFF

IGNITER INCORPORATING A SAFETY LOCKING DEVICE

BACKGROUND OF THE INVENTION

The present invention relates in general to the field of igniters, and more particularly, to igniters having a child resistant feature in the nature of a safety release locking trigger.

An igniter is generally a multi-purpose lighting device which is operative for producing a flame at the end of an elongated nozzle. Igniters have a variety of household and commercial applications, for example, for lighting barbecues, fireplaces, candles, torches, tobacco products, gas stoves, pilot lights, etc. Igniters are now being regulated to require child safety features similar to regulations pertaining to disposable lighters. The idea of the child safety feature is to preclude a curious child from lighting an igniter and accidentally causing burns to the child or starting another fire.

Known igniters make use of a release button located generally on top of the trigger housing. The idea being that a child could not press down the release button and squeeze the trigger at the same time. One known construction depends on the amount of force used to depress the release button. Another known construction relies on the rotation direction of a wheel to release the trigger, e.g., see U.S. Pat. No. 6,093,017. Both of these methods are awkward to operate the igniter unless the adult has both dexterity and strength in a single hand. Otherwise an adult requires two hands to operate the igniter that in the past required only one hand. Other known constructions are disclosed in U.S. Pat. Nos. 5,897,308; 5,697,775; 5,967,768; 6,042,367 and 6,022,212.

The present invention overcomes the problem of making an igniter difficult for young children to operate and yet leave the igniter easy for an adult to operate.

SUMMARY OF THE INVENTION

The present invention is directed to an igniter incorporating a safety locking device in the nature of a safety release locking trigger having a release slide associated therewith. The release slider in accordance with the present invention is located on the trigger itself. This allows one finger to operate both the release slider and the trigger instead of two separate fingers or finger/thumb movements to be coordinated. To decrease the likelihood that the release slider could accidentally be activated, the trigger's shape slopes in such a way as to move the operator's finger away from the release slider. It takes a deliberate action to both hold the release slide in the unlocked position and to move the trigger to operate the igniter. This combination allows a method to effectively hinder young children from operating the igniter without depending on adult finger strength to unlock the igniter.

The release slider is referred to as a slider since it is moved or slid "out of the way" instead of being pushed in. If you try to operate the igniter like it's a non-child resistant model and push the release slider in along with trying to pull the trigger back, the trigger will not move. Instead the release slider tends to be an obstacle to the finger. Any attempt to operate the trigger just by placing the finger (or in the case of a child, fingers) on the trigger and squeezing fails to unlock the trigger and thus operate the igniter.

To operate the igniter, the release slider is moved upward to unlock the trigger. It can be thought of as clearing the safety lock out of the way of the trigger. The release slider is held in the up or cleared position, as just moving it momentarily up does not allow operation of the igniter. Since the slope of the trigger is forward as one moves from bottom to top, the release slider's motion is also slightly forward instead of the more intuitive movement backwards which is the operating direction of the trigger.

This configuration is counter-intuitive to what is thought to be normal operation of a trigger on an igniter. The method is to hold the release slider up before and during the squeezing of the trigger. Since the finger tends to travel downwards (due to the trigger's slope) during depressing the trigger, a deliberate action on the part of the operator to hold the finger in the upper part of the trigger is needed to successfully ignite the igniter. The operation of the igniter is a learned method from reading the instructions and not dependent on operator force. A learned technique is more user friendly than relying on brute force or coordinating two fingers to unlock the safety locking device.

In accordance with one embodiment of the present invention there is described an igniter comprising a housing; a stop member within the housing; a fuel reservoir within the housing; a nozzle in fluid communication with the reservoir; an actuating assembly within the housing for controlling the supply of fuel from the reservoir to the nozzle and for igniting fuel discharged from the nozzle; and a trigger including a trigger body and a slider coupled to the trigger body, the trigger body moveable between a first position and a second position along a first path, the trigger body operating the actuating assembly when in the second position, the slider moveable along the trigger body between a first position and a second position along a second path different from the first path, the slider having a first portion arranged outside the housing and a second portion arranged inside the housing, the second portion of the slider arranged in interfering relationship with the stop member when the slider is in the first position whereby the trigger body is precluded from movement from the first position to the second position thereof, and the second portion of the slider being arranged in non-interfering relationship within the stop member when in the second position whereby the trigger body is moveable from the first position to the second position thereof for operating the actuating assembly.

In accordance with another embodiment of the present invention there is described an igniter comprising a housing; a stop member in the housing; a fuel reservoir within the housing; a nozzle attached to the housing; a burner within the nozzle; a valve for opening and closing a path of fuel from the reservoir to the burner; a piezo-electric unit for generating a discharge voltage for lighting the fuel; and an operation member which effects operation of the valve and the piezo-electric unit for lighting the igniter; the safety device comprising a trigger including a trigger body and a slider movably coupled to the trigger body, the trigger body moveable between a first position and a second position along a first path, the trigger body actuating the operation member when in second position, the slider moveable along the trigger body between a first position and a second position along a second path different from the first path, the slider having a first portion accessibly arranged outside the housing and a second portion inaccessibly arranged inside the housing, the second portion of the slider arranged in interfering relationship with the stop member when the slider is in the first position whereby the trigger body is precluded from movement from the first position to the second position thereof, and the second portion of the slider being arranged in non-interfering relationship within the stop member when in the second position whereby the trigger body is moveable from the first position to the second position thereof for actuating the operation member.

In accordance with another embodiment of the present invention there is described an igniter comprising a housing; a fuel reservoir within the housing; a valve within the housing for opening and closing a path of fuel from the reservoir; a piezo-electric unit within the housing for lighting the fuel discharged from the reservoir; and a safety device comprising a trigger including a trigger body and a slider coupled to the trigger body, the trigger body moveable between a first position and a second position along a first path, the trigger body actuating the valve and the piezoelectric unit when in the second position, the slider moveable along the trigger body between a first position and a second position along a second path different from the first path, the slider having an accessible first portion and a second portion arranged in interfering relationship with a portion of the housing when the slider is in the first position whereby the trigger body is precluded from movement from the first position to the second position thereof, and the second portion of the slider being arranged in non-interfering relationship within the portion of the housing when in the second position whereby the trigger body is moveable from the first position to the second position thereof.

BRIEF DESCRIPTION OF THE DRAWINGS

The above description, as well as further objects, features and advantages of the present invention will be more fully understood with reference to the following detailed description of an igniter incorporating a safety locking device, when taken in conjunction with the accompanying drawings, wherein.

DETAILED DESCRIPTION

In describing the preferred embodiments of the present invention, specific terminology will be resorted to for the sake of clarity. However, the invention is not intended to be limited to the specific terms so selected, and is to be understood that each specific term includes all technical equivalence which operate in a similar manner to accomplish a similar purpose.

Figure 1:
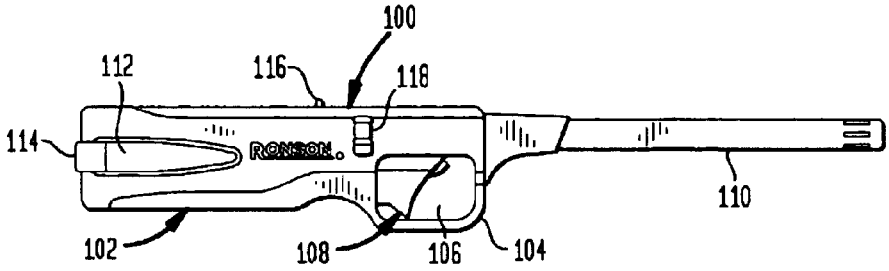
FIG. 1 is a front elevational view of an igniter constructed in accordance with one embodiment of the present invention.

Referring now to the drawings, wherein like reference numerals represent like elements, there is shown in FIG. 1 an igniter generally designated by reference numeral 100. The igniter 100 includes a housing 102 formed with a trigger guard 104 defining a trigger opening 106 which receives a safety release locking trigger 108. The housing 102 can be formed from two molded housing halves which are mated and attached together during the assembly of the igniter 100. An elongated nozzle 110 extends outwardly from one end of the housing 102. A fuel reservoir 112 having a refill inlet valve 114 is positioned within the other end of the housing 102. The fuel reservoir 112 provides a source of liquid butane which may be refilled through inlet valve 114. A gas flow control lever 116 is accessible from outside the housing 102 for controlling the flow rate of butane from the fuel reservoir 112, thereby controlling the degree of the resulting flame produced by the igniter 100. An additional safety locking switch 118 may be provided at an easily accessible location on the housing 102 for manually locking the trigger 108.

Figure 2:
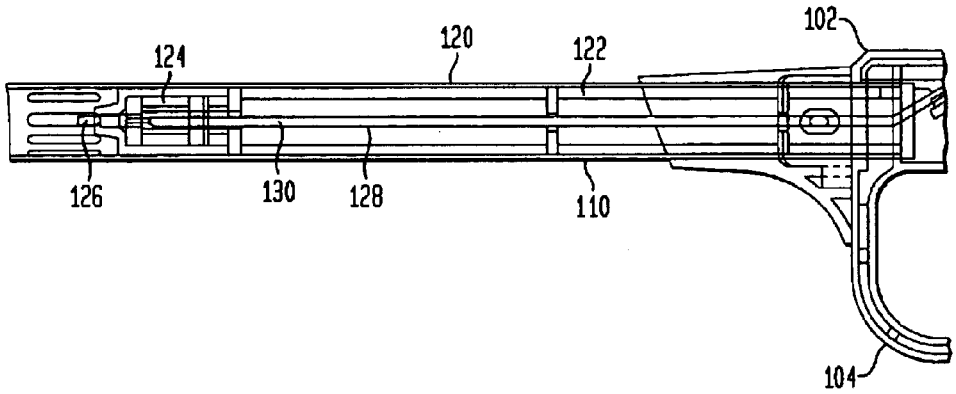
FIG. 2 is a partial cross-sectional view of the construction of the igniter nozzle.

As shown in FIG. 2, the nozzle 110 includes an elongated hollow tube 120 supporting a generally coextensive inner sleeve 122. A gas burner 124 having an outwardly facing burner nozzle 126 and spark electrode is positioned within the free end of the nozzle 110 for igniting the butane. As is conventional in known igniters, liquid butane is discharged from the fuel reservoir 112 in the form of butane gas through an appropriate on/off control outlet valve for regulating its flow. The butane is fed through a gas tubing 128 to the burner 124. The butane is ignited at the burner nozzle 126 by an electric spark created by the piezo-electric unit which is supplied to the spark electrode at the burner 124 via piezo wire 130. The ignited butane forms a continuous flame at the burner nozzle 126 as long as the trigger 108 is held in an operative position for maintaining the control valve in an open condition. It is to be understood that variations in the foregoing construction of the igniter such as known generally in the igniter art may be adapted for use in the igniter 100.

Figure 3:
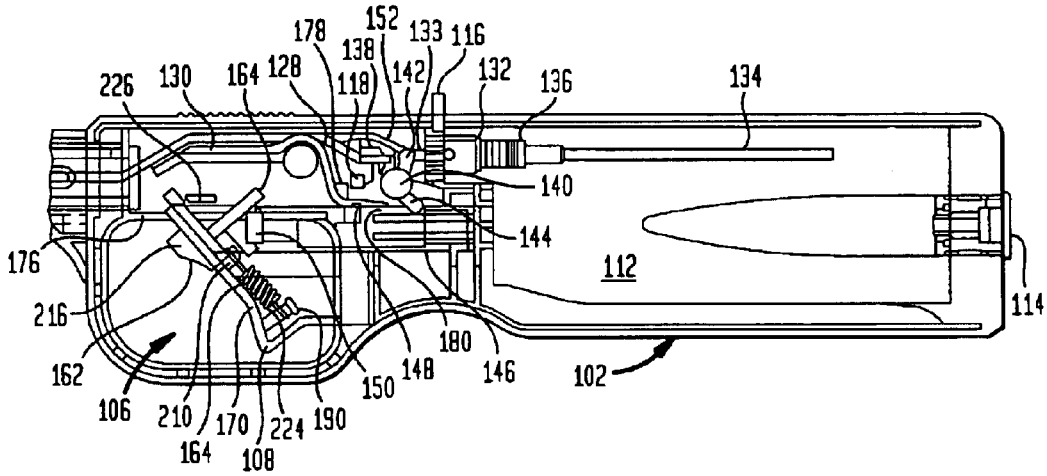
FIG. 3 is a partial cross-sectional view of the igniter housing showing the igniter components in assembled operative relationship.

As shown in FIG. 3, the fuel reservoir 112 is supplied with a source of liquid butane or other suitable fuel which is combustible in operation of the igniter 100. The fuel is supplied from the reservoir 112 to a burner valve assembly 132 through a wick assembly 134 provided with an inline filter 136. The burner valve assembly 132 includes an outlet valve 133 and an outlet nozzle 138 which is connected to the gas tubing 128 which extends through the nozzle 110 to the burner 124. The outlet valve 133 is opened and closed by means of the operation of a gas lever 140 which is pivotably mounted within the housing 102. The gas lever 140 has three projections, e.g., a pair of projections 142 and a single projection 144 which extend radially outward therefrom. Projections 142 are arranged in operative association with the outlet valve 133 while projection 144 is arranged in operative association with the trigger 108. As to be described hereinafter, operation of the trigger 108 engages projection 144, thereby rotating the gas lever 140 whereby projections 142 will open the outlet valve 133 to allow the flow of butane from the reservoir 112 to the burner 124 via tubing 128. As previously discussed, the butane flow rate can be regulated by control lever 116 which is coupled to the outlet valve 133.

A piezo-electric unit 146 has a contact end 148 connected to the piezo wire 130 and a slidable spring biased actuating plunger 150 in operative association with the trigger 108. The inward displacement of the actuating plunger 150 provides a discharge voltage to an electrode adjacent the burner nozzle 126, the nozzle 110 being grounded via ground wire 152. The resulting spark created by the operation of the piezo-electric unit 146 will ignite the butane at the burner nozzle 126. The general construction and operation of an igniter which includes a nozzle 110, gas burner 124, burner valve assembly 132 and piezo-electric unit 146 are known to those skilled in the igniter art. Accordingly, one skilled in the igniter art would understand the construction and operation of the igniter as thus far described, as well as variations thereof.

In accordance with the present invention, the liquefied fuel fills the reservoir 112 up to about 85% of its capacity. Fuel vapor is released from the reservoir 112 while the outlet valve 133 is activated and transferred through gas tubing 128 to the burner 124 in the front of the nozzle 110. The outlet valve 133 is operated by gas lever 140, which in turn, is rotated by the trigger 108 after release of the safety locking mechanism to be described.

Figure 4A:
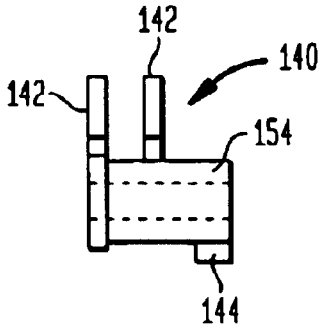
FIG. 4A is a right side elevational view of the gas lever.
Figure 4B:
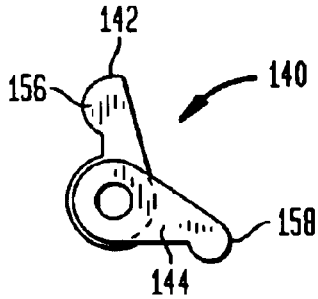
FIG. 4B is a front elevational view of the gas lever.

As shown in FIGS. 4A, 4B, the gas lever 140 includes a cylindrical hub 154 from which there extends a pair of spaced apart radial projections 142 each having a lateral bulge 156. Projection 144 is formed as a single projection also having a bulge 158. As shown in FIG. 3, the bulges 156 on the projections 142 are arranged for engagement with a collar on the outlet valve 133 of the burner valve assembly 132. On the other hand, the bulge 158 of projection 144 is arranged for engagement with the trigger 108. The space between the projections 142 receives the outlet nozzle 138 of the burner valve assembly 132. The source of ignition of the gas is provided by the piezo-electric unit 146 which generates a high voltage spark if sufficient force is applied to the actuating plunger 150. The actuating plunger 150 is spring loaded and is directly activated (depressed) by the trigger 108.

The construction of the trigger 108 in accordance with one embodiment of the present invention will now be described. With reference to FIG. 3, the trigger 108 includes a trigger body 160, a release slider 162 and a trigger bridge 164. The trigger body 160, as shown in greater detail in FIGS. 5A–5F, includes a first wall 166 spaced from a second wall 168 by a transversely connected end wall 170 forming an opening therebetween. The outer surface of the end wall 170 provides a sloped finger engaging surface as to be described with respect to the operation of the trigger 108. The upper portion of the outer surfaces of first and second walls 166, 168 are provided with longitudinally extending grooves 172, 174. The grooves 172, 174 receive a pair of spaced apart elongated ribs 176 which are formed extending inwardly from the inner surfaces of the housing halves of the housing 102 adjacent the trigger opening 106 as shown in FIG. 3. The trigger body 160 is therefore slidable longitudinally within the housing 102 along the longitudinally axis of the grooves 172, 174 and ribs 176. One upper corner of first wall 166 is formed with a projecting abutment 178, while the corresponding upper corner of second wall 168 is formed with an elongated outwardly extending projection 180 arranged generally in collinear alignment with groove 174.

Disposed on the upper edges of the first and second walls 166, 168 are a pair of spaced apart triangular members 182, 184 each having a groove 186 formed in their inner surface. The grooves 186 extend downwardly at an angle to the longitudinal axis of the grooves 172, 174 into a portion of the inner surface of the first and second walls 166, 168, see FIG. 5E. The end wall 170 is provided with a slot 188 extending partially from its upper edge as shown in FIG. 5D. A pin 190 projects inwardly between the first and second sidewalls 166, 168 at a lower portion of the end wall 170 as shown in FIG. 5E.

Figure 6A:
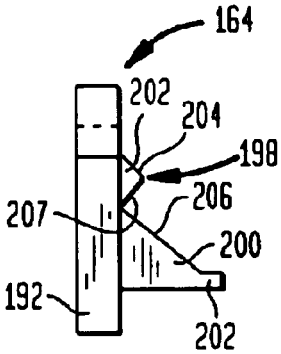
FIG. 6A is a right side elevational view of the trigger bridge.
Figure 6B:
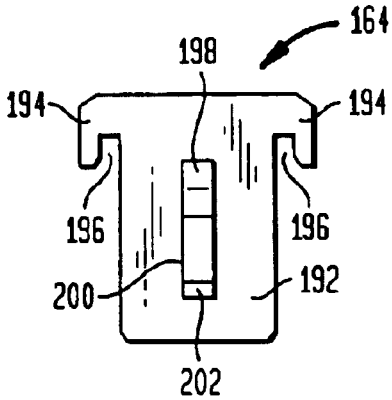
FIG. 6B is a front elevational view of the trigger bridge.
Figure 7A:
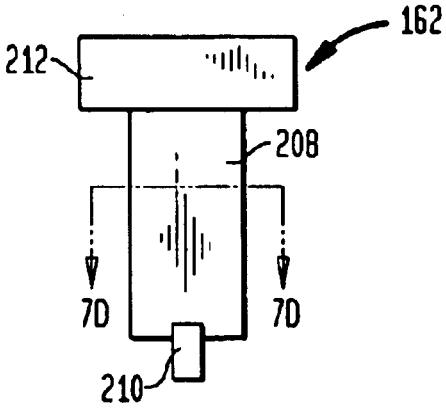
FIG. 7A is a front elevational view of the release slider.
Figure 7B:
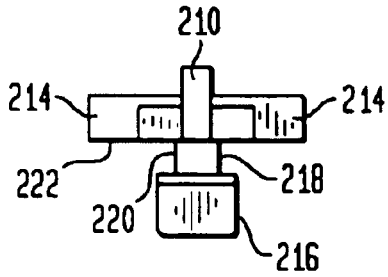
FIG. 7B is a bottom plan view of the release slider.
Figure 7C:
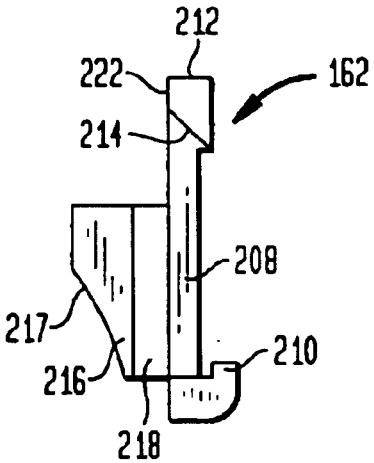
FIG. 7C is a right side elevational view of the release slider.
Figure 7D:
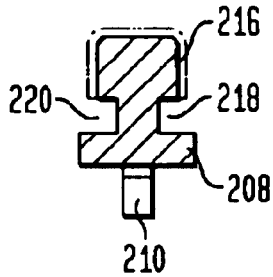
FIG. 7D is a cross-sectional view taken along lines 7D—7D in FIG. 7A.

The bridge 164 is shown in greater detail in FIGS. 6A, 6B. The bridge 164 includes a generally rectangular wall 192 formed at its upper corners with a pair of spaced apart hook-like members 194 which each define an adjacent opening 196. Positioned along a central vertical axis of the wall 192 is a first triangular member 198 in collinear alignment with a second larger triangular member 200 having a rectangular end 202. As shown in FIG. 6A, outer surfaces 204, 206 of the triangular members 198, 200 are arranged parallel to each other, with end surface 207 of member 198 being transverse to surface 206.

Figure 5A:
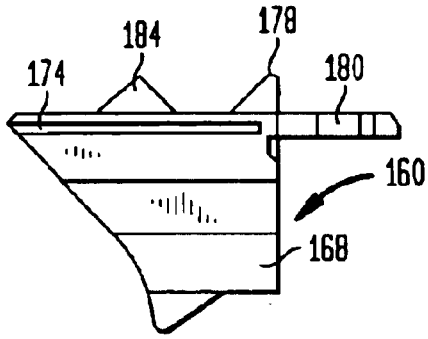
FIG. 5A is a front elevational view of the trigger body.
Figure 5B:
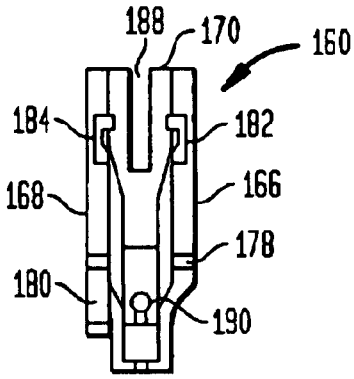
FIG. 5B is a top plan view of the trigger body.
Figure 5E:
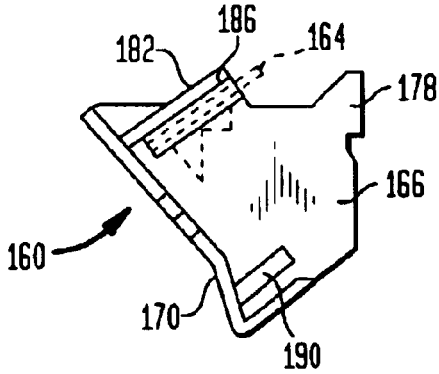
FIG. 5E is a cross-sectional view taken along lines 5E—5E in FIG. 5D.
Figure 5C:
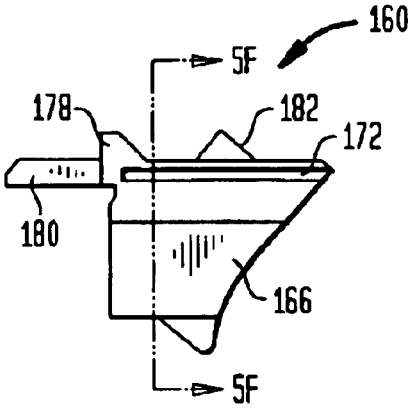
FIG. 5C is a rear elevational view of the trigger body.
Figure 5D:
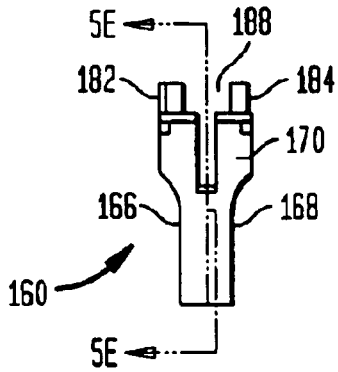
FIG. 5D is a right side elevational view of the trigger body.
Figure 5F:
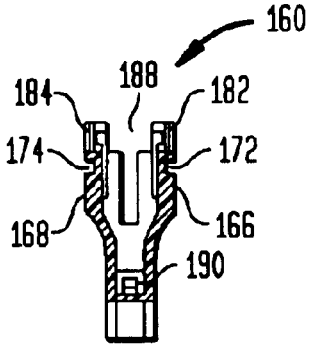
FIG. 5F is a cross-sectional view taken along lines 5F—5F in FIG. 5C.

As shown in FIGS. 3 and 5E, the bridge 164 is slidingly received within the grooves 186 formed in the triangular members 182, 184. The upper edges of the triangular members 182, 184 are captured within the openings 196 formed by the hook-like members 194. As shown in assembled relationship, the surfaces 204, 206 of the triangular members 198, 200 are arranged transversely to the longitudinal axis of the grooves 172, 174 within the first and second walls 166, 168 of the trigger body 160. Although described as two separate components, the trigger body 160 and bridge 164 may be formed as a single integral component.

The release slider 162 will now be described with reference to FIGS. 7A–7D. The slider 162 includes a planar wall 208 having at its lower end a projecting hook-like member 210. A rectangular cross member 212 is provided at the other end of wall 208 having inclined lateral edges 214 facing downwardly in the opposite direction to the hook-like member 210. The cross-member 212 has end portions extending outwardly beyond the extent of the wall 208. An elongated rib 216 having a T-shaped cross-section by means of spaced apart elongated grooves 218, 220 extends outwardly from the center of the rear surface 222 of wall 208. The rib 216 is formed with a curved finger engaging outer surface 217. The trigger body 160, slider 162 and bridge 164 as thus far described can be integrally formed such as by injection molding from suitable plastic material.

As shown in FIG. 3, the release slider 162 is assembled in relationship within the interior of the trigger body for sliding movement along the inner surface of end wall 170. In this regard, the rear surface 222 of wall 208 of slider 162 closely overlies the inner surface of wall 170 of the trigger body 160. The rib 216 projects outwardly through the slot 188 so as to be accessible within the trigger opening 106. The slider 162 is maintained in its assembled relationship by the lateral edges of the end wall 170 which form the slot 188 being received within the grooves 218, 220 on either side of the rib 216. In its lowermost position within the trigger body 160, as shown in FIG. 3, the lateral edges 214 of the cross-member 212 are adjacent the top edge of the first and second walls 166, 168 of the trigger body 160. A bias latch spring 224 is attached between pin 190 and hook-like member 210 so as to bias the slider 162 in the direction of the pin. The slider 162 can therefore slide upwardly along the inner surface of end wall 170 against the bias force of latch spring 224 upon upward manipulation of the rib 216 with a sufficient counterforce.

The end wall 170 is arranged at an angle to the longitudinal axis of the grooves 172, 174. Accordingly, the slider 162 moves along an axis at a corresponding angle to the longitudinal axis of the grooves 172, 174 which is the direction of movement of the trigger body 160. By way of example, an angle greater than 30° and less than about 90° is contemplated, and preferably an angle of about 50°. It should be understood that the trigger body 160 is moved longitudinally through the housing 102 along the axis defined by the grooves 172, 174. On the other hand, the slider 162 is moved along a different axis defined generally by the grooves 218, 220 of the rib 216 which supports the slider within the end wall 170. This arrangement results in the trigger body 160 being manipulated rearwardly towards the fuel reservoir 112, while the slider 162 is moved in an opposite upward and forward direction towards nozzle 110.

In assembled relationship, the trigger 108 is accessible within the trigger opening 106 defined by the trigger guide 104. As shown in FIG. 3, the actuator plunger 150 of the piezo-electric unit 146 is engaged with the surface 206 defined by triangular member 200 of the trigger bridge 164. The free end of projection 180 extending from the trigger body 160 is arranged adjacent bulge 158 on leg 144 of the gas lever 140. The trigger 108 is precluded from being depressed by the ends of the cross-member 212 of the slider 162 opposing in interfering facing relationship with a pair of spaced apart stop members 226 projecting inwardly from the inner surfaces of the housing halves which define the housing 102. The length of the stop members 226 is preferably longer than the extent of travel of the cross-member 212 when the trigger 108 is depressed for igniting the igniter 100. In the preferred embodiment, the cross-member 212 is precluded from being moved by operation of the trigger 108 beyond the length of the stop members 226. This prevents the slider 162 from dropping behind the stop members 226 which would preclude the return of the trigger 108 when released. Although the preferred embodiment has been described as constructed with two opposing stop members 226, only one stop member may be used for interfering with the slider 162.

Figure 8A:
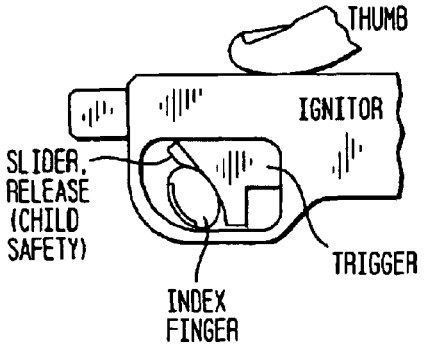
FIGS. 8A–8D are sequential illustrations showing operation of the igniter.
Figure 8B:
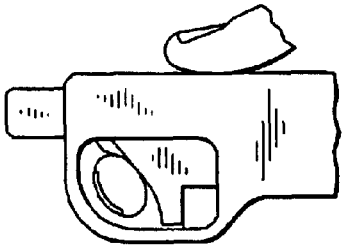
Figure 8C:
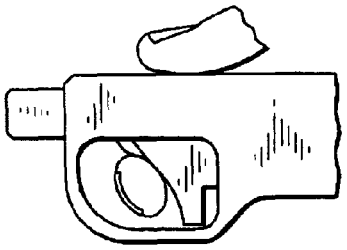
Figure 8D:
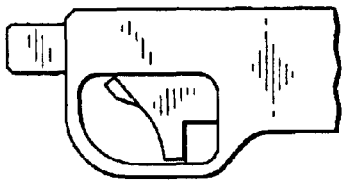

The operation of the igniter 100 will now be described initially with reference to FIGS. 8A–8D. In order to operate the igniter 100, a person first slides the safety lock 118 on the outside of the housing 102 up (the direction opposite to "lock" arrow). Then the operator places their index finger on the trigger 108 and thumb on an optional ridged pad on the top of the igniter 100 (FIG. 8A). The operator then moves their index finger upwards and forwards along the trigger's end wall 170 and into engagement with the outer surface 217 of the rib 216 of the release slider 162. This motion moves the slider 162 upward at a forward angle into the unlocked position (FIG. 8B) whereby the cross-member 212 is cleared of the locking members 226. While holding the slider 162 in the release position, trigger body 160 is then squeezed back (FIG. 8C) until the piezo-electric unit 146 is activated by engagement with bridge 164 and butane is sent from the reservoir 112 to the burner 124. The igniter 100 can produce flame when trigger 108 is fully depressed (stroke about 5 mm or 0.200"). After releasing the index finger, the trigger 108 automatically returns back (pushed by the piezo-electric unit's spring), the fuel outlet valve 133 is returned to the off position, extinguishing the flame and the slider 162 is automatically reset into its locking position by the latch spring 224 (FIG. 8D).

The child resistant mechanism is based on the construction of the release slide 162 that is pushed and held in a direction opposite to the natural direction of trigger movement. Placing the thumb on the top of the igniter 100 at a designated location, e.g., ridged pad, helps to make the motion of the index finger easier. To release the trigger 108 it is almost a pinching action between the thumb and the index finger. The upward and angled movement of the index finger moves the slider 162 against the latch spring 224 whereby the cross-member 212 is no longer in interference relationship with the stop members 226. When the slider 162 moves upward into the housing 102 far enough, this releases the trigger 108 and allows for its actuating motion. Even if the safety lock 118 on the side of the igniter 100 is left in the "on" position, the trigger 108 cannot be squeezed unless an adult-sized index finger lifts the slider 162. Most children will mimic the motions they see their parents make which is to pull back the trigger 108. Doing so, even with multiple fingers pulling on the trigger 108 and thus pushing the slider 162 in the wrong direction only locks the trigger more. Two sequential motions (lifting and holding the slider 162 then depressing the trigger 108) make it very difficult for a child with small fingers to produce the flame with the igniter 100.

Figure 9B:
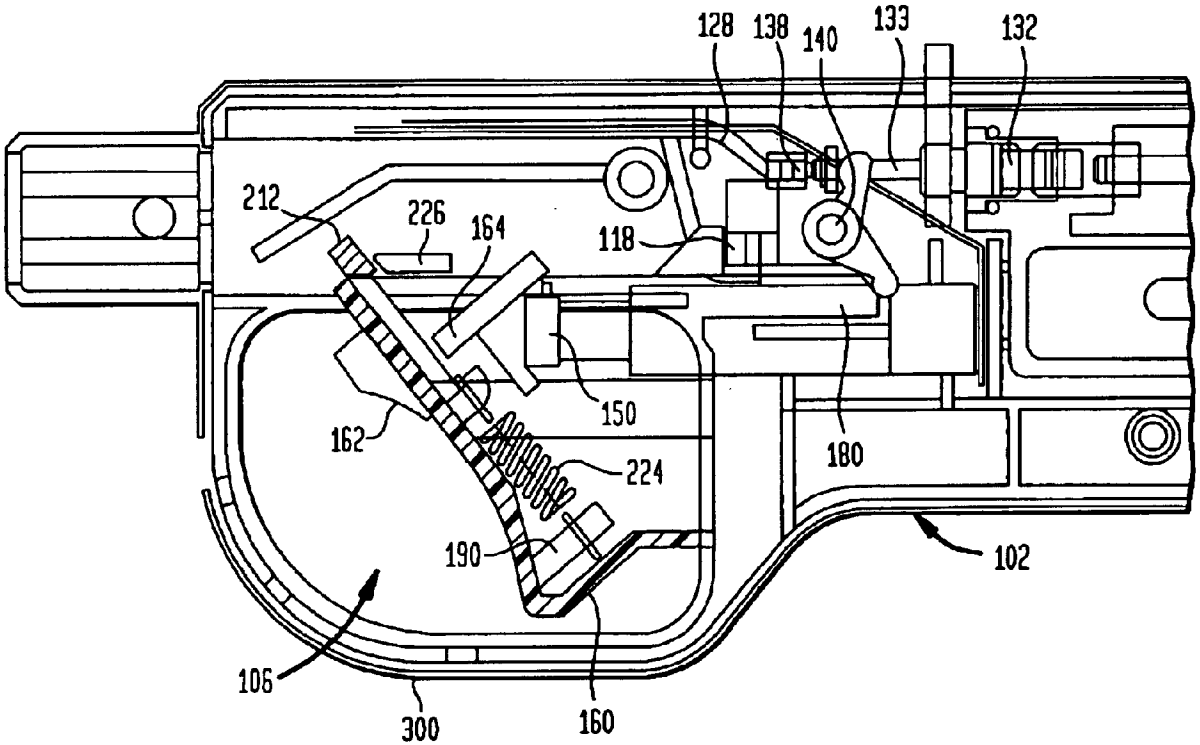
FIGS. 9A–9B are partial cross-sectional views of the igniter in accordance with one embodiment of the present invention showing the release slider in a locked position.
Figure 9A:
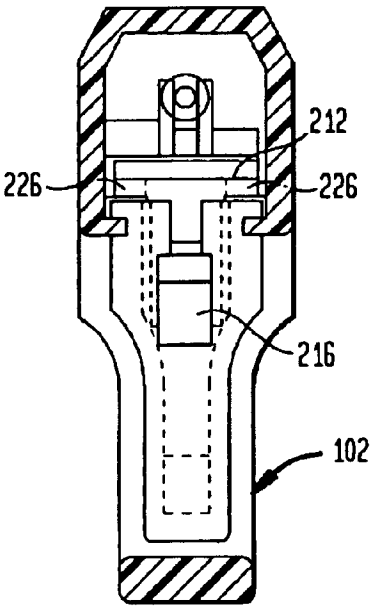
Figure 10B:
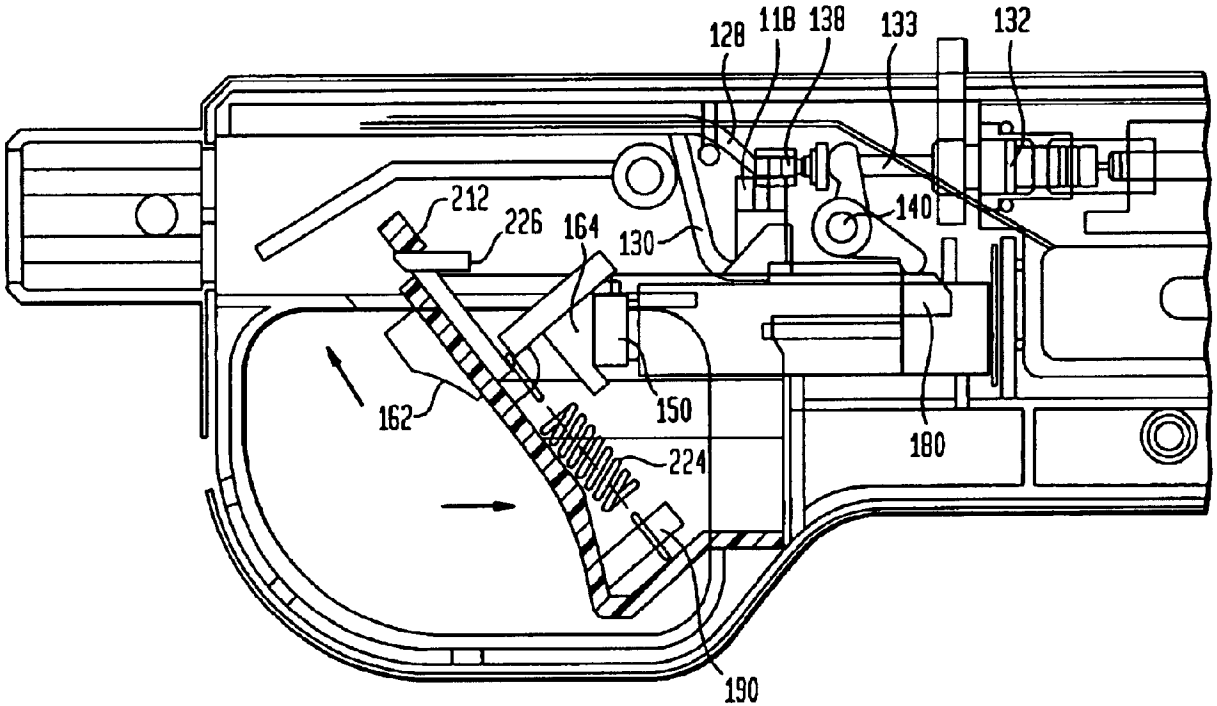
FIGS. 10A–10B are partial cross-sectional views of the igniter shown in FIGS. 9A and 9B showing the release slider in an unlocked position permitting operation of the trigger.
Figure 10A:
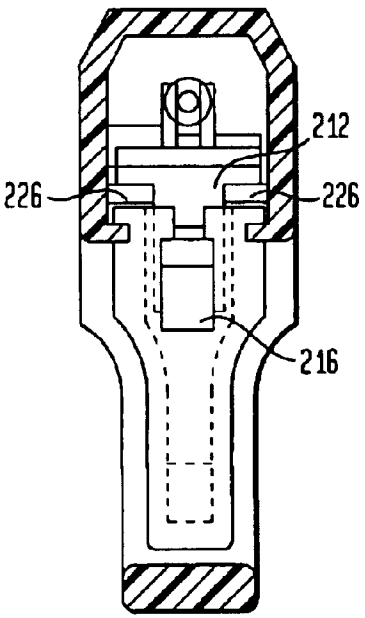

More specifically as shown in FIGS. 9A, 9B, the trigger release slider 162 is initially biased downwardly by the action of bias latch spring 224. In the locked position, the cross-member 212 of the slider 162 is arranged opposing the stop members 226. Any attempt to manipulate the trigger 108 to effect lighting of the igniter 100 will be prevented by the cross-member 212 engaging the stop members 226. Also, with the safety lock 118 in the lock position, the trigger body 160 is prevented from being depressed by abutment of the safety lock with the abutment 178 extending from the trigger body. To effect operation of the igniter 100, the safety lock 118 is first moved to the unlock position as shown in FIG. 10B where it does not interfere with the abutment 178. The trigger 108 is then released by sliding the release slider 162 along the trigger body 160 until the cross-member 212 is positioned above and out of interfering relationship with the stop members 226 as shown in FIGS. 10A, 10B. While maintaining the release slider 162 in its released position, the trigger body 160 can be depressed along its longitudinal axis in a direction which will cause the bridge 164 to depress the actuating plunger 150 of the piezo-electric unit 146. At the same time, the projection 180 extending from the trigger body 160 will engage the gas lever 140 thereby rotating same counterclockwise so as to open the outlet valve 133.

Figure 11:
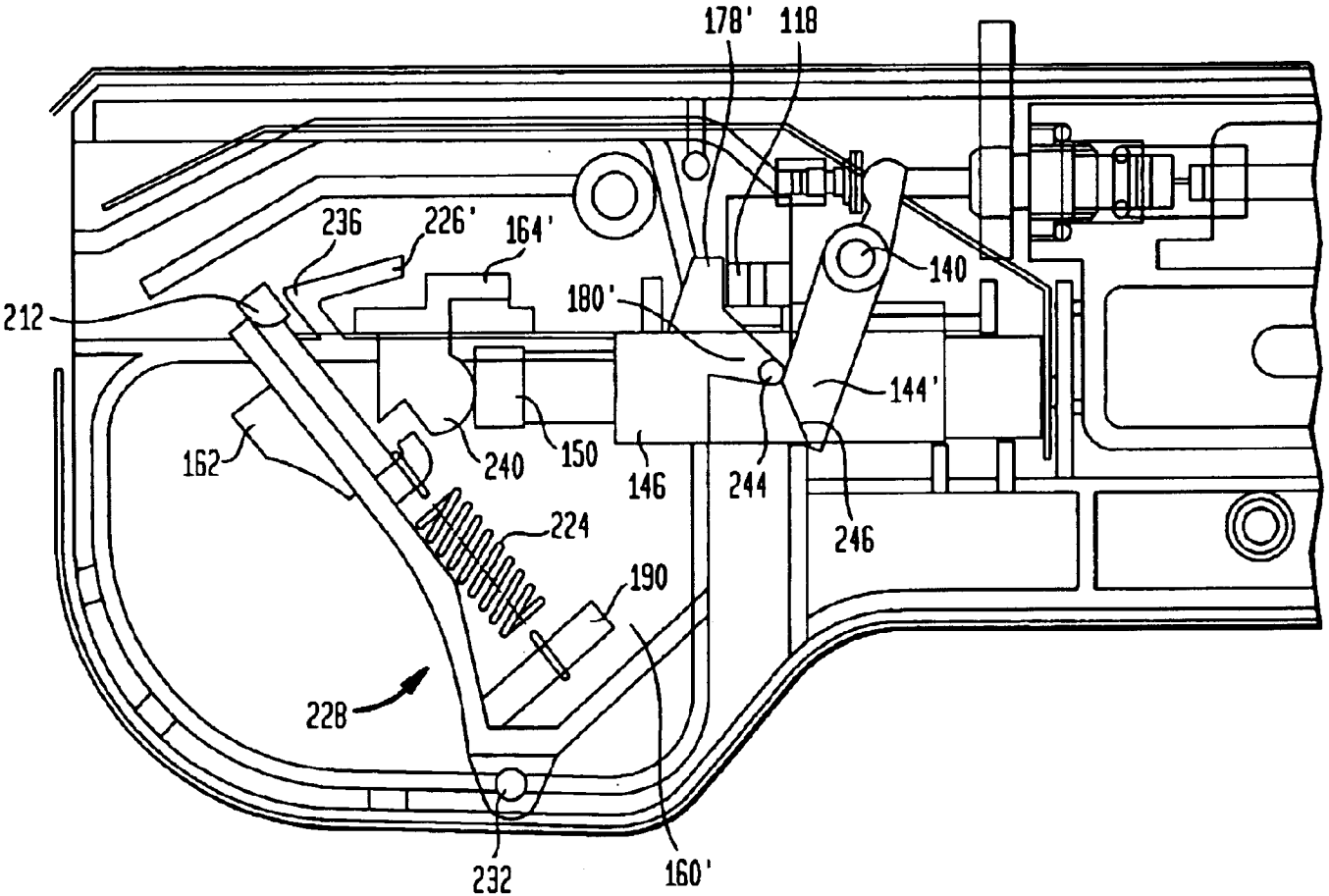
FIG. 11 is a partial cross-sectional view of an igniter having a safety release locking trigger constructed in accordance with another embodiment of the present invention arranged in a locked position.
Figure 12:
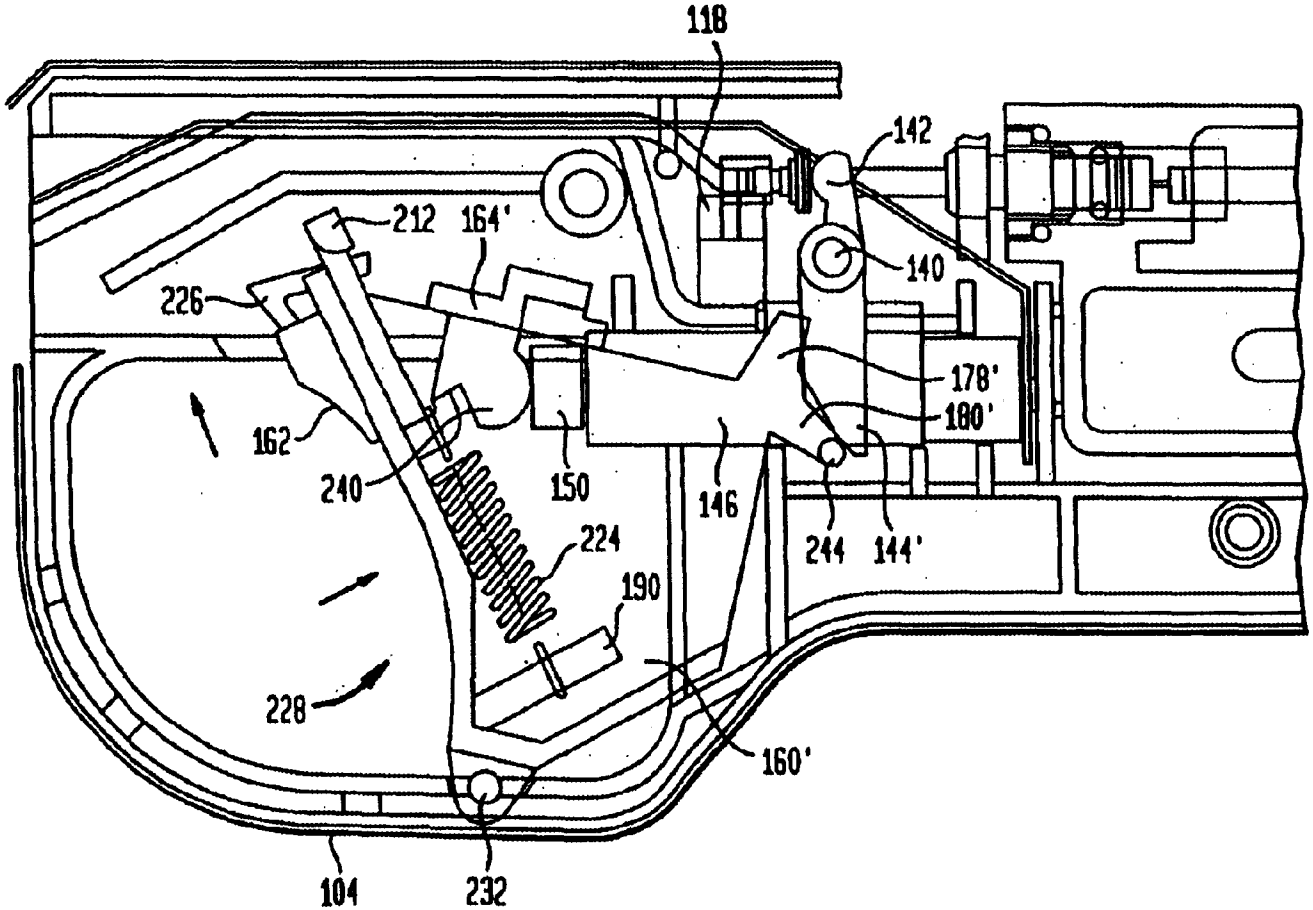
FIG. 12 is a partial cross-sectional view showing the release slider in FIG. 11 in an unlocked position to permit operation of the safety release locking trigger.

Referring to FIGS. 11 and 12, there will be described a safety locking trigger 228 constructed in accordance with another embodiment of the present invention wherein like reference numerals will correspond to like elements with respect to the igniter 100. The safety locking trigger 228 includes a trigger body 160' which is pivotably attached at pivot point 232 to the trigger guard 104. The pair of stop members 226' are arranged at an angle to the longitudinal axis of the housing 102. As shown, the stop members 226' have an engagement face 236 arranged generally at the same angle as the slider 162. The bridge 164' is provided with a curved member 240 which engages the actuating plunger 150 of the piezo-electric unit 146. The trigger body 160' is provided with a projection 180' including at its end a round pin 244 which abuts against a sloping surface 246 of an extended leg 144' of the gas lever 140. The release slider 162 is movable against the bias latch spring 224 in the manner as thus far described whereby the cross-member 212 will be positioned out of interference with the stop members 226'. The trigger body 160' can now be rotated about is pivot point 236 to activate the igniter 100.

In both embodiments, the geometry of the gas lever 140 and the projecting pin 244 and projection 180 are such that the lever fully activates the gas valve 133 at the beginning of the trigger motion to improve the ignition efficiency, first gas has to flow to the nozzle 110, then a spark is generated. During the second phase of the trigger motion, the gas lever 140 is not rotated further, the gas valve 133 staying in an open position, to avoid an over travel of the valve.

There has thus far been described a safety locking trigger for an igniter in accordance with various embodiments of the present invention. It is to be understood that in order to activate the igniter repeatedly, the safety locking trigger 108, 228 and the release slider 162 should generally be returned to its normal fully released position. Otherwise, the piezo-electric unit 146 will not be in a position to generate an additional spark. Due to constraints of the hammer mechanism in the piezo-electric unit 146, the actuating plunger 150 must start from its initial position to generate a spark.

Although the invention herein has been described with reference to particular embodiments, it is to be understood that these embodiments are merely illustrative of the principles and applications of the present invention. Further, any range of numbers or ratios recited in the specification or paragraphs hereinafter describing various aspects of the invention, such as that representing a particular set of properties, units of measure, conditions, physical states or percentages, is intended to literally incorporate expressly herein by reference or otherwise, any number falling within such range, including any subset of numbers or ranges subsumed within any range so recited. It is therefore to be understood that numerous modifications may be made to the illustrative embodiments and that other arrangements may be devised without departing from the spirit and scope of the present invention as defined by the appended claims.

What is claimed is:

1. An igniter comprising a housing having first and second ends; a stop member within said housing; a fuel reservoir within said housing; a nozzle extending from said housing at said first end in fluid communication with said reservoir; an actuating assembly within said housing f or controlling the supply of fuel from said reservoir to said nozzle and for igniting fuel discharged from said nozzle; and a trigger including a trigger body and a slider coupled to said trigger body, said trigger body moveable between a first position and a second position along a first path towards said second end of said housing, said trigger body operating said actuating assembly when in said second position, said slider moveable along said trigger body between a first position and a second position along a second path towards said nozzle at an angle less than 90° to said first path, said slider having a first portion arranged outside said housing and a second portion arranged inside said housing, said second portion of said slider arranged in interfering relationship with said stop member when said slider is in said first position whereby said trigger body is precluded from movement from said first position to said second position thereof, and said second portion of said slider being arranged in non-interfering relationship with said stop member when in said second position whereby said trigger body is moveable from said first position to said second position thereof for operating said actuating assembly.

2. The igniter of claim 1, wherein said first path is a linear path.

3. The igniter of claim 1, wherein said first path is an arcuate path.

4. The igniter of claim 1, wherein said second path is at an angle greater than 30° to said first path.

5. The igniter of claim 1, wherein said second path is at an angle of about 50° to said first path.

6. The igniter of claim 1, further comprising a spring coupled between said slider and said trigger body, whereby said slider is biased towards said first position.

7. The igniter of claim 1, wherein said trigger body is pivotably attached to said housing for rotation along said first path.

8. The igniter of claim 1, further comprising a trigger guard attached to said housing forming an opening, said trigger body and said slider accessible within said opening.

9. The igniter of claim 1, wherein said trigger body includes a first portion for operating said actuating assembly for controlling the supply of fuel from said reservoir and a second portion for operating said actuating assembly for igniting said fuel.

10. The igniter of claim 9, wherein said first portion of said trigger body comprises a projection arranged in operative association with a gas lever operative of a gas valve for controlling the supply of fuel from said reservoir.

11. The igniter of claim 9, wherein said second portion of said trigger body comprises a bridge arranged in operative association with a piezo-electric unit for igniting the fuel discharge from said nozzle.

12. An igniter comprising a housing; a stop member in said housing; a fuel reservoir within said housing; a nozzle attached to said housing; a burner within said nozzle; a valve for opening and closing a path of fuel from said reservoir to said burner; a piezo-electric unit for generating a discharge voltage for lighting said fuel; an operation member which effects operation of the valve and the piezo-electric unit for lighting said igniter; said safety device comprising a trigger including a trigger body and a slider movably coupled to said trigger body, said trigger body moveable between a first position and a second position along a first path towards said fuel reservoir, said trigger body actuating said operation member when in second position, said slider moveable along said trigger body between a first position and a second position along a second path towards said nozzle at an angle less than 90° to said first path, said slider having a first portion accessibly arranged outside said housing and a second portion inaccessibly arranged inside said housing, said second portion of said slider arranged in interfering relationship with said stop member when said slider is in said first position whereby said trigger body is precluded from movement from said first position to said second position thereof, and said second portion of said slider being arranged in non-interfering relationship within said stop member when in said second position whereby said trigger body is moveable from said first position to said second position thereof for actuating said operation member.

13. The igniter of claim 12, wherein said first path is a linear path.

14. The igniter of claim 12, wherein said first path is an arcuate path.

15. The igniter of claim 12, wherein said second path is at an angle greater than 30° to said first path.

16. The igniter of claim 12, wherein said second path is at an angle of about 50° to said first path.

17. The igniter of claim 12, further comprising a spring coupled between said slider and said trigger body, whereby said slider is biased towards said first position.

18. The igniter of claim 12, wherein said trigger body is pivotably attached to said housing for rotation along said first path.

19. The igniter of claim 12, further comprising a trigger guard attached to said housing forming an opening, said trigger body and said slider accessible within said opening.

20. The igniter of claim 12, wherein said trigger body includes a first portion effecting operation of said valve when in said second position.

21. The igniter of claim 12, wherein said trigger body includes a second portion effecting operation of said piezo-electric unit when in said second position.

22. An igniter comprising a housing; a fuel reservoir within said housing; a valve within said housing for opening and closing a path of fuel from said reservoir; a piezo-electric unit within said housing for lighting said fuel discharged from said reservoir; and a safety device comprising a trigger including a trigger body and a slider coupled to said trigger body, said trigger body moveable between a first position and a second position along a first path, said trigger body actuating said valve and said piezo-electric unit when in said second position, said slider moveable in a direction away from said fuel reservoir along said trigger body between a first position and a second position along a second path different from said first path, said second path being along an angle less than 90° to said first path, said slider having an accessible first portion and a second portion arranged in interfering relationship with a portion of said housing when said slider is in said first position whereby said trigger body is precluded from movement from said first position to said second position thereof, and said second portion of said slider being arranged in non-interfering relationship within said portion of said housing when in said second position whereby said trigger body is moveable from said first position to said second position thereof.

23. The igniter of claim 22, wherein said first path is a linear path.

24. The igniter of claim 22, wherein said second path is at an angle greater than 30° to said first path.

25. The igniter of claim 22, wherein said second path is at an angle of about 50° to said first path.

26. The igniter of claim 22, further comprising a spring coupled between said slider and said trigger body, whereby said slider is biased towards said first position.

27. The igniter of claim 22, wherein said trigger body is pivotably attached to said housing for rotation along said first path.

28. The igniter of claim 22, wherein said trigger body includes a first portion for operating said valve and a second portion for operating said piezo electric unit.

29. The igniter of claim 28, wherein said first portion of said trigger body comprises a projection arranged in operative association with said valve.

30. The igniter of claim 28, wherein said second portion of said trigger body comprises a bridge arranged in operative association with a piezo-electric unit.

31. The igniter of claim 22, wherein said trigger body comprises a pair of spaced apart walls attached at one end by an end wall having a slot therein.

32. The igniter of claim 31, wherein said slider is arranged between said spaced apart walls adjacent said end wall, said slider having a rib extending outwardly through said slot.

33. The igniter of claim 22, wherein said housing comprises a pair of opposing housing halves, said portion of said housing comprising a stop member extending inwardly from at least one of said housing halves.

34. The igniter of claim 33, wherein the length of said stop member is longer than the travel distance of said trigger body along said first path.

35. The igniter of claim 22, wherein said first path is an arcuate path.

36. A method of actuating an igniter comprising a housing having first and second ends; a stop member within said housing; a fuel reservoir within said housing; a nozzle extending from said first end of said housing in fluid communication with said reservoir; an actuating assembly within said housing for controlling the supply of fuel from said reservoir to said nozzle and for igniting fuel discharged from said nozzle; and a trigger including a trigger body and a slider coupled to said trigger body, said method comprising moving said slider along said trigger body between a first position and a second position towards said first end of said housing along a first path, said slider having a first portion arranged outside said housing and a second portion arranged inside said housing; moving said trigger body between a first position and a second position towards said second end of said housing along a second path different from said first path, said trigger body operating said actuating assembly when in said second position; arranging said second portion of said slider in interfering relationship with said stop member when said slider is moved to said first position whereby said trigger body is precluded from movement from said first position to said second position thereof; and arranging said second portion of said slider in non-interfering relationship within said stop member when moved to said second position whereby said trigger body is moveable from said first position to said second position thereof for operating said actuating assembly.

37. The method of claim 36, wherein said second path is a linear path.

38. The method of claim 36, wherein said second path is an arcuate path.

39. The method of claim 36, wherein said first path is at an angle greater than 30° to said second path.

40. The method of claim 36, wherein said first path is at an angle of about 50° to said second path.

41. The method of claim 36, further comprising biasing said slider towards said first position by a spring coupled between said slider and said trigger body.

42. The method of claim 36, further comprising pivotably attaching said trigger body to said housing for rotation along said second path.

43. The method of claim 36, further comprising said trigger body including a first portion and a second portion, and operating said actuating assembly for controlling the supply of fuel from said reservoir using said first portion and operating said actuating assembly for igniting said fuel using said second portion.

44. The method of claim 43, wherein said first portion of said trigger body comprises a projection arranged in operative association with a gas lever operative of a gas valve for controlling the supply of fuel from said reservoir.

45. The method of claim 43, wherein said second portion of said trigger body comprises a bridge arranged in operative association with a piezo-electric unit for igniting the fuel discharge from said nozzle.

46. A method of operating an igniter comprising a housing having first and second ends; a stop member within said housing; a fuel reservoir within said housing adjacent said second end; a nozzle extending from said housing at said first end in fluid communication with said reservoir; an actuating assembly within said housing for controlling the supply of fuel from said reservoir to said nozzle and for igniting fuel discharged from said nozzle; a trigger including a trigger body; and a slider coupled to said trigger body, said slider having a first portion arranged outside said housing and a second portion arranged inside said housing: said method comprising moving said slider along said trigger body between a first position and a second position towards said nozzle along a first path, whereby said second portion of said slider is positioned in non-interfering relationship with said stop member; and moving said trigger body between a first position and a second position towards said fuel reservoir along a second path different from said first path, said trigger body operating said actuating assembly when in said second position.

47. The method of claim 46, wherein said second path is a linear path.

48. The method of claim 46, wherein said second path is an arcuate path.

49. The method of claim 46, wherein said first path is at an angle greater than 30 to said second path.

50. The method of claim 46, wherein said first path is at an angle of about 50° to said second path.

51. The method of claim 46, further including pivotably attaching said trigger body to said housing for rotation along said second path.

52. The method of claim 46, further including arranging said slider in said first position whereby said second portion of said slider is positioned in interfering relationship with said stop member whereby said trigger body is precluded from movement from said first position to said second position thereof.

53. An igniter comprising a housing having first and second opposite ends; a stop member within said housing; a fuel reservoir within said housing adjacent said first end; a nozzle at said second end of said housing in fluid communication with said reservoir; an actuating assembly within said housing for controlling the supply of fuel from said reservoir to said nozzle and for igniting fuel discharged from said nozzle; and a trigger including a trigger body and a slider coupled to said trigger body, said trigger body moveable between a first position and a second position along a first path, said trigger body operating said actuating assembly when in said second position, said slider moveable along said trigger body between a first position and a second position along a second path different from said first path, said first path being in a direction towards said first end of said housing and second path being in a direction towards said second end of said housing, said slider having a first portion arranged outside said housing and a second portion arranged inside said housing, said second portion of said slider arranged in interfering relationship with said stop member when said slider is in said first position whereby said trigger body is precluded from movement from said first position to said second position thereof, and said second portion of said slider being arranged in non-interfering relationship with said stop member when in said second position whereby said trigger body is moveable from said first position to said second position thereof for operating said actuating assembly.

54. The igniter of claim 53, wherein said second path is at an angle greater than 30 degrees to said first path.

55. The igniter of claim 53, wherein said second path is at an angle of about 50 degrees to said first path.

56. An igniter comprising a housing having first and second opposite ends; a stop member in said housing; a fuel reservoir within said housing adjacent said first end; a nozzle attached to said housing at said second end of said housing; a burner within said nozzle; a valve for opening and closing a path of fuel from said reservoir to said burner; a piezo-electric unit for generating a discharge voltage for lighting said fuel; an operation member which effects operation of the valve and the piezo-electric unit for lighting said igniter; said safety device comprising a trigger including a trigger body and a slider movably coupled to said trigger body, said trigger body moveable between a first position and a second position along a first path, said trigger body actuating said operation member when in second position, said slider moveable along said trigger body between a first position and a second position along a second path different from said first path, said first path being in a direction towards said first end of said housing and second path being in a direction towards said second end of said housing, said slider having a first portion accessibly arranged outside said housing and a second portion inaccessibly arranged inside said housing, said second portion of said slider arranged in interfering relationship with said stop member when said slider is in said first position whereby said trigger body is precluded from movement from said first position to said second position thereof, and said second portion of said slider being arranged in non-interfering relationship with said stop member when in said second position whereby said trigger body is moveable from said first position to said second position thereof for actuating said operation member.

57. The igniter of claim 56, wherein said second path is at an angle greater than 30 degrees to said first path.

58. The igniter of claim 56, wherein said second path is at an angle of about 50 degrees to said first path.

59. An igniter comprising a housing; a fuel reservoir within said housing; a valve within said housing for opening and closing a path of fuel from said reservoir; a piezo-electric unit within said housing for lighting said fuel discharged from said reservoir; and a safety device comprising a trigger including a trigger body and a slider coupled to said trigger body, said trigger body moveable between a first position and a second position towards said fuel reservoir along a first path, said trigger body actuating said valve and said piezo-electric unit when in said second position, said slider moveable in a direction away from said fuel reservoir along said trigger body between a first position and a second position along a second path different from said first path, said second path being along an angle less than 90° to said first path, said slider having an accessible first portion and a second portion arranged in interfering relationship with a portion of said housing when said slider is in said first position whereby said trigger body is precluded from movement from said first position to said second position thereof, and said second portion of said slider being arranged in non-interfering relationship with said portion of said housing when in said second position whereby said trigger body is moveable from said first position to said second position thereof.

60. The igniter of claim 59, wherein said second path is at an angle greater than 30 degrees to said first path.

61. The igniter of claim 59, wherein said second path is at an angle of about 50 degrees to said first path.

62. A method of operating an igniter comprising a housing having a first and second opposite ends; a stop member within said housing; a fuel reservoir within said housing adjacent said first end; a nozzle at said second end of said housing in fluid communication with said reservoir; an actuating assembly within said housing for controlling the supply of fuel from said reservoir to said nozzle and for igniting fuel discharged from said nozzle; a trigger including a trigger body; and a slider coupled to said trigger body, said slider having a first portion arranged outside said housing and a second portion arranged inside said housing: said method comprising moving said slider along said trigger body between a first position and a second position along a first path, whereby said second portion of said slider is positioned in non-interfering relationship with said stop member; and moving said trigger body between a first position and a second position along a second path different from said first path, said first path being in a direction towards said first end of said housing and said second path being in a direction toward said second end of said housing, said trigger body operating said actuating assembly when in said second position.

63. The method of claim 59, wherein said first path is at an angle greater than 30 degrees to said second path.

64. The method of claim 59, wherein said first path is at an angle of about 50 degrees to said second path.

* * * * *

UNITED STATES PATENT AND TRADEMARK OFFICE

CERTIFICATE OF CORRECTION

PATENT NO. : 6,840,759 B2 
DATED : January 11, 2005
INVENTOR(S) : Louis V. Aronson, II, Adam Grabicki and Lee J. Hadfield It is certified that error appears in the above-identified patent and that said Letters Patent is hereby corrected as shown below:

Column 1,
Line 38, "leave" should read -- leaves --.

Column 3,
Lines 13-14, "piezoelectric" should read -- piezo-electric --.

Column 5,
Line 56, "spring loaded" should read -- spring-loaded --.

Column 6,
Line 2, delete "are" and insert therefor -- is --.

Column 9,
Line 13, delete "is" and insert therefor -- its --.
Line 22, "over travel" should read -- over-travel --.
Line 28, delete "its" and insert therefor -- their --.
Line 54, delete "f or" and insert therefor -- for --.

Column 11,
Line 58, "piezoelectric" should read -- piezo-electric --.

Column 13,
Line 26, "30" should read -- 30° --, and line 53, after "and" insert -- said --.

Column 14,
Line 20, after "and" insert -- said --, and line 66, delete "a" (first occurrence).

Signed and Sealed this

Third Day of May, 2005

JON W. DUDAS
*Director of the United States Patent and Trademark Office*